US008008844B2

(12) United States Patent
Sasai et al.

(10) Patent No.: US 8,008,844 B2
(45) Date of Patent: Aug. 30, 2011

(54) TRIPLE WALLED LAMP

(75) Inventors: Yasushi Sasai, Saitama (JP); Tsugio Sekiguchi, Saitama (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 105 days.

(21) Appl. No.: 12/496,754

(22) Filed: Jul. 2, 2009

(65) Prior Publication Data

US 2010/0007264 A1 Jan. 14, 2010

(30) Foreign Application Priority Data

Jul. 4, 2008 (JP) ..... 2008-176052
Aug. 21, 2008 (JP) ..... 2008-5843
Aug. 26, 2008 (JP) ..... 2008-217056

(51) Int. Cl.
*H01J 61/52* (2006.01)
*H01J 61/30* (2006.01)

(52) U.S. Cl. ..... 313/25; 313/238; 313/318.01; 313/634

(58) Field of Classification Search ..... 220/2.1 R, 220/2.2; 313/25, 26, 318.01, 625, 43, 50, 313/238, 292, 634; D26/138
See application file for complete search history.

(56) References Cited

U.S. PATENT DOCUMENTS

| | | | | |
|---|---|---|---|---|
| 4,825,128 | A * | 4/1989 | Sprengers | 315/58 |
| 5,065,069 | A * | 11/1991 | Hunter | 313/25 |
| 5,270,608 | A * | 12/1993 | Williamson et al. | 313/25 |
| 5,619,090 | A * | 4/1997 | Vervecken | 313/25 |
| 2008/0090483 | A1 * | 4/2008 | Fridrich | 445/26 |

FOREIGN PATENT DOCUMENTS

| | | |
|---|---|---|
| EP | 1983550 | 10/2008 |
| JP | 1318637 | 11/2007 |
| WO | 2007/088729 | 8/2007 |

* cited by examiner

*Primary Examiner* — Karabi Guharay
*Assistant Examiner* — Michael Santonocito
(74) *Attorney, Agent, or Firm* — Greenblum & Bernstein P.L.C.

(57) ABSTRACT

A lamp in which an inner bulb containing a light emitting tube or a light emitting filament and an outer bulb containing the inner bulb are attached coaxially to a base, and a spacer made of a thin metal sheet is attached to an exhaust tube protruding from a central region at the top end of the inner bulb coaxially supporting the inner bulb to the outer bulb. The spacer has a central plate formed with an aperture allowing the exhaust tube to be inserted through the central plate, and a plurality of fingers protruding inward along the inner periphery of the aperture, and three or more strips, each branched radially outward from the central plate and formed in a curved shape coaxially supporting the inner bulb and the outer bulb.

9 Claims, 9 Drawing Sheets

TRIPLE WALLED LAMP

BACKGROUND OF THE INVENTION

1. Field of the Invention

The present invention concerns a lamp having an inner bulb for containing a light emitting tube or a light emitting filament and an outer bulb for containing the inner bulb attached coaxially to a base and it particularly relates to a lamp in which a spacer made of a thin metal sheet for coaxially supporting the inner bulb to the outer bulb is attached to an exhaust tube also referred to as a chip pipe that protrudes from a central region at the top end of the inner bulb.

2. Description of the Related Art

In the manufacturing process of a triple-walled metal halide lamp having a light emitting tube, an inner bulb for containing the light emitting tube, and an outer bulb for containing the inner bulb, or a double-walled halogen lamp having an inner bulb for containing a light emitting filament and an outer bulb for containing the inner bulb, a low temperature curable heat resistant inorganic adhesive paste, for example, SUMICERAM (trade name of products manufactured by Asahi Chemical Co., Ltd.) is coated and filled between a base and bottom ends of the inner bulb and the outer bulb attached coaxially to the base and the adhesive is heated to a curing temperature to secure the inner bulb and the outer bulb to the base. However, since the inner bulb contained in the outer bulb by capping the outer bulb thereover cannot be supported coaxially with the base from the outside, when the outer bulb is capped over the inner bulb and the pasty adhesive is coated between the ends of both of the bulbs and the base, the inner bulb may be inclined to sometimes result in failure of products in which the light distribution property of the lamp is deteriorated.

Then, a prior lamp is shown in. FIG. 10 and FIG. 11, in which a light emitting tube 51, an inner bulb 52 for containing the light emitting tube 51, and an outer bulb 53 for containing the inner bulb 52 are attached coaxially to a base 54, and a spacer $S_x$ made of a thin metal sheet is attached to the top end 52a of the inner bulb 52 for coaxially supporting the inner bulb 52 to the outer bulb 53. (Refer Patent Document 1)

Each of the inner bulb 52 and the outer bulb 53 is a cylindrical tube having a top end 52*a*, 53*a* formed into a spherical shape. The inner bulb 52 has an exhaust tube (chip pipe) 55 protruded from the central portion at the top end 52*a* thereof for exhausting the inside of the inner value 52 and sealing an inert gas or the like to the inside thereof in the manufacturing process of the lamp. The exhaust tube 55 has a bottom end 52*b* crushed to a flattened shape by pinch seal and is secured at the bottom end by means of a heat resistant adhesive to the base 54.

Further, the base 54 to which the inner bulb 52 and the outer bulb 53 are attached has a cylindrical peripheral wall 56 formed along the outer periphery thereof for inwardly fitting the bottom end 53*b* of the outer bulb 53. The base 54 has a supporting post 57 formed to a central region thereof for inserting a pinch sealed bottom end 52*b* of the inner bulb 52 between a pair of columnar portions 58, 58 thereby attaching the inner bulb 52 in an upright state.

The spacer $S_x$ has a circular ring-shaped central plate 59 pivoted to the exhaust tube 55, which is protruded from the central region at the spherical top end 52*a* of the inner bulb 52 by insertion of the exhaust tube 55 through a circular hole 60 and three strips 61, 61 - - - branched radially each at an equal distance from the central plate 59 and extended lengthwise from the top end 52*a* to the bottom end 52*b* of the inner bulb 52. Each of the strips 61, 61, - - - is configured such that the top end thereof is curved so as to protrude inward in an arcuate shape to form an arcuate portion 62 and abut against the outer surface of the inner bulb 52, and a portion near the top end thereof is bulged semi-spherically outward to form a convex portion 63 that abuts against the inner surface of the outer bulb 53.

Then, when the outer bulb 53 is capped over the inner bulb 52 as shown in FIG. 10, since the strips 61, 61, - - - of the spacer $S_x$ attached to the exhaust tube 55 protruded from the central region at the top end 52*a* of the inner bulb 52 is put between the cylindrical outer periphery of the inner bulb 52 and the cylindrical inner periphery of the outer bulb 53 to ensure a predetermined distance between them, thereby supporting the inner bulb 52 coaxially to the outer bulb 53 as shown in FIG. 11. This can prevent inclination of the inner bulb 52 when the inner bulb 52 and the outer bulb 53 are secured to the base 54 by means of the pasty heat resistant adhesive.

However, since the spacer $S_x$ is structured such that three strips 61, 61, - - - extend lengthwise from the top end to the bottom end of the inner bulb 52, the three strips 61, 61, - - - interrupt a light emitted from the light emitting tube 51 contained in the inner bulb 52 to result in a drawback of causing uneven illumination or shadow and, at the same time, remarkably lowering the efficiency of utilizing an effective light.

Further, when the length of the strips 61, 61, - - - of the spacer $S_x$ is shortened for overcoming the drawback described above, this may result in a state that the strips 61, 61, - - - are pulled out of the gap between the outer periphery of the inner bulb 52 and the inner periphery of the outer bulb 53 by vibrations or impact shocks exerting during transportation of a lamp, and the central plate 59 of the spacer $S_x$ falls off from the exhaust tube 55 to incline the spacer $S_x$ or detach the spacer from the top end 53*a* of the inner bulb 52, thereby disfigure the appearance of the lamp to possibly invite complains in view of the quality.

Further, in the lamp of the type described above, the outer bulb may possibly be disengaged and dropped from the base by the lowering of the adhesion strength of the heat resistant adhesive that secures the outer bulb to the base due to aging deterioration (thermal deterioration). Then, for preventing dropping of the outer bulb by the deterioration of the adhesive, a metal vapor discharge lamp shown in FIG. 12 was proposed, in which an outer bulb 74 is secured to a base 75 by a bayonet mechanism. (Refer Patent Document 2)

As a bayonet mechanism, WO 2007/088729 discloses a system of engaging a convex portion 82 as a bayonet finger protruded inward of an opening 77 of the outer bulb 74 to a concave portion 83 formed as a bayonet groove to the periphery of the base 75 as shown in FIG. 12 and FIG. 13(*a*), and a system of engaging a convex portion 84 protruded as a bayonet finger to the periphery of the base 75 to an L-shape recess 85 formed as a bayonet groove by recessing the outer bulb 74 on the side of the opening thereof in a hooked shape to the open end as shown in FIG. 13(*b*).

Then, the outer bulb 74 is secured to the base 75 by a fabrication procedure of at first coating a pasty heat resistant adhesive between the open end of the outer bulb 74 and the base 75 to which the open end is abutted, then rotating or twisting the outer bulb 74, thereby securing the outer bulb 74 to the base 75 by the bayonet mechanism, by engaging the convex portion 82 formed as the bayonet finger at the outer bulb 74 and the concave portion 83 formed as the bayonet groove to the base 75 to each other in a case of FIG. 13(*a*), or engaging the convex portion 84 formed as the bayonet finger to the base 75 and the L-shaped recess 85 as the bayonet groove formed to the outer bulb 74 to each other in a case of FIG. 13(*b*), and then curing the heat resistant adhesive coated as described above thereby bonding the open end of the outer bulb 74 to the base 75 by the adhesive for preventing the dropping of the outer bulb 74 out of the base 75 by the rotation of the outer bulb 74 in the direction of disengaging the engaged state between the bayonet finger and the bayonet groove caused by vibrations, etc.

However, since the fabrication procedure of securing the outer bulb 74 to the base lamp 74 by means of the bayonet mechanism and the adhesive is complicated in view of the fabrication step and takes much time, this may possibly lower the productivity of the lamp remarkably. Further, in the bayonet mechanism, since the bayonet finger has to be engaged by screwing into the bayonet groove, this may possibly damage the convex portion 82 as the bayonet finger formed in the outer bulb 74 shown in FIG. 13(*a*) or damage the L-shaped recess 85 as the bayonet groove formed in the outer bulb 74 shown in FIG. 13(*b*), for example, by inadequate control for applying a force that exerts upon screwing operation.

Further, since the convex portion 82 formed to the outer bulb 74 and the concave portion 83 formed in the supporting post 79 of the attaching base 76 of the base 75 shown in FIG. 13(*a*) have to be fabricated each into such a shape and a size as capable of engagement to each other so as to constitute the bayonet finger and the bayonet groove and the L-shaped recess 85 formed in the outer bulb 74 and the convex portion 84 formed to the base 75 also have to be fabricated each into such a shape and a size as capable of engagement to each other so as to form the bayonet groove and the bayonet finger, this involves a problem of making the fabrication troublesome and increasing the fabrication cost.

3. List of Prior Art

Patent Document 1: Japanese Design Registration No. 1318637.

Patent Document 2: WO 2007/088729

SUMMARY OF THE INVENTION

In view of the foregoings, as a main subject, the present invention intends to prevent or suppress that a spacer which is attached to an exhaust tube protruded from the central region at the top end of an inner bulb for coaxially supporting the inner bulb to the outer bulb interrupts a light emitted from the inner bulb, thereby causing uneven illumination or shadow and lowering the efficiency of utilizing an effective light, as well as reliably prevent dropping out or inclination of the spacer from the inner bulb, which may disfigure the appearance of the lamp.

For solving the subject, the present invention provides a lamp in which an inner bulb for containing a light emitting tube or a light emitting filament and an outer bulb for containing the inner bulb are attached coaxially to a base, and a spacer made of a thin metal sheet is attached to an exhaust tube protruded from the central region at the top end of the inner bulb for coaxially supporting the inner bulb to the outer bulb, wherein the spacer has a central plate formed with an aperture for allowing the exhaust tube to be inserted therethrough and a plurality of fingers protruded inward along the inner periphery of the aperture, and three or more strips each branched radially outward from the central plate and formed into a curved shape for coaxially supporting the inner bulb to the outer bulb, and the top end of the exhaust tube is configured as a stopper capable of inhibiting the movement of the fingers toward the top end of the exhaust tube, thereby preventing the central plate from dropping out of the exhaust tube.

In the lamp according to the invention, when the exhaust tube protruded from the central region at the top end of the inner bulb is inserted through the aperture formed in the central plate of the spacer, the fingers protruded inward along the inner periphery of the aperture are inhibited from the movement toward the top end of the exhaust tube thereby preventing the central plate of the spacer from dropping out of the exhaust tube. Then, even when the strips of the spacer are formed in the curved shape for supporting the inner bulb coaxially to the outer bulb in the vicinity of the top end of the inner bulb so as not to interrupt the light emitted from the inner bulb, the spacer is not dropped out or inclined from the inner bulb, which may disfigure the appearance of the lamp by vibrations or impact shocks exerting during transportation of the lamp.

DESCRIPTION OF PREFERRED EMBODIMENTS

In a preferred embodiment of a lamp according to the invention, an inner bulb for containing a light emitting tube or a light emitting filament and an outer bulb for containing the inner bulb are attached coaxially to a base by means of a heat resistant inorganic adhesive, and a spacer made of a thin metal sheet is attached to an exhaust tube protruded from the central region at the top end of the inner bulb for coaxially supporting the inner bulb to the outer bulb.

The spacer is made of a spring stainless steel of about 0.2 mm thickness and formed into a shape having a central plate formed with a circular aperture for allowing an exhaust tube protruded from the central region at the top end of the inner bulb to be inserted therethrough and 3 to 4 fingers each protruded inward at an equal angular distance along the inner periphery of the circular aperture, and 3 to 4 strips formed so as to be branched radially outward each at an equal angular distance from the central plate and formed each into a curved shape for coaxially supporting the inner bulb to the outer bulb.

Further, the central plate of the spacer has an annular rib for reinforcing the strength thereof formed coaxially with the circular aperture for allowing the exhaust tube to be inserted therethrough. Further, the strip of the spacer is formed such that it abuts against the inner periphery of the outer bulb in the vicinity of the top end of the inner bulb for coaxially supporting the inner bulb to the outer bulb, or formed into a curved shape put between the inner periphery of the outer bulb and the outer periphery of the inner bulb in the vicinity of the top end of the inner bulb for coaxially supporting the inner bulb to the outer bulb.

The exhaust tube protruded from the central region at the top end of the inner bulb is configured as a stopper by crushing the top end in a heat-softened state in the axial direction of the exhaust tube to be thickened toward the end (clavate shape) upon chipping off an extra length of the tube by burning off the same by means of an oxyhydrogen flame or a carbon dioxide laser in the course of manufacturing the lamp, thereby capable of preventing the fingers formed to the circular aperture of the central plate of the spacer through which the top end of the exhaust tube is inserted from moving toward the top end of the tube.

First Embodiment

Figure 1A:
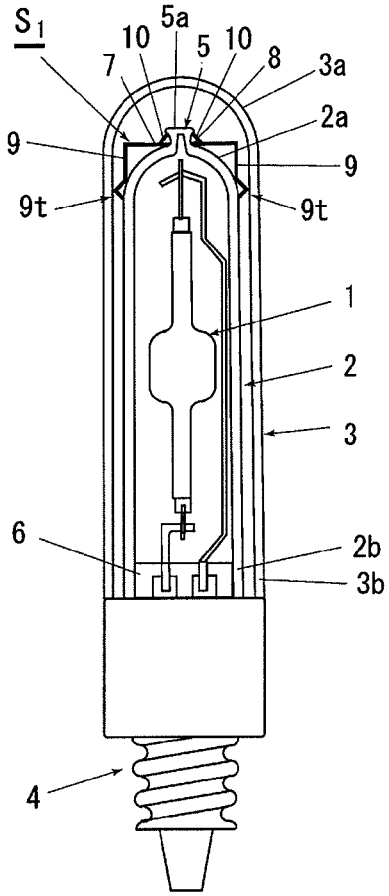
FIGS. 1(*a*)-(*b*) show a cross section of a lamp according to a first embodiment of the invention in which FIG. 1(*a*) is an entire view of the lamp and FIG. 1(*b*) is an enlarged fragmentary view of the lamp.
Figure 1B:
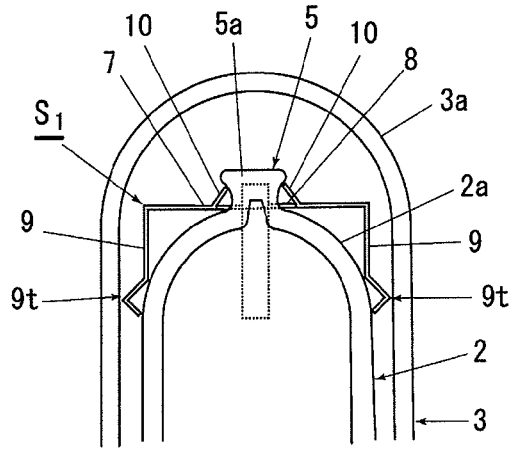
Figure 2:
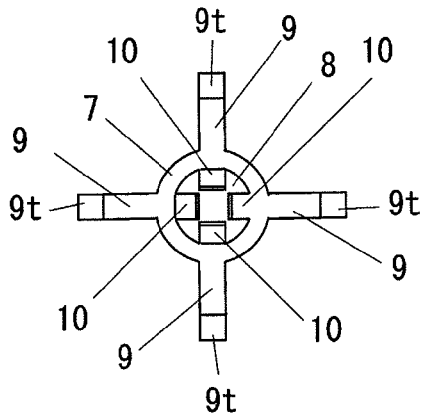
FIG. 2 is a plan view of a spacer used in the lamp shown in FIG. 1.
Figure 3A:
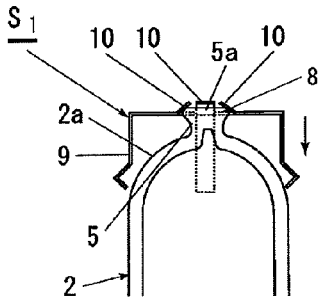
FIGS. 3(*a*)-(*c*) are explanatory views showing the process of attaching the spacer of FIG. 2 to an inner bulb of the lamp.
Figure 3B:
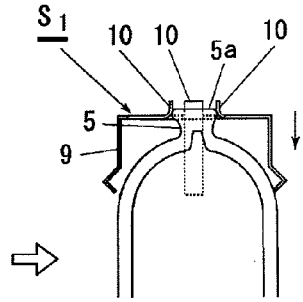
Figure 3C:
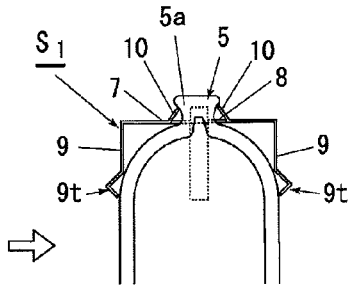

FIG. 1(*a*) is an entire view and FIG. 1(*b*) is an enlarged fragmentary cross sectional view of a lamp according to the first embodiment of the invention, FIG. 2 is a plan view of a spacer used for the lamp, and FIG. 3(*a*) to FIG. 3(*c*) show the state of attaching the spacer shown in FIG. 2 to the inner bulb of the lamp.

The lamp of this embodiment is a triple-walled metal halide lamp in which a light emitting tube 1 made of translucent ceramics, an inner bulb 2 for containing the light emitting tube 1, and an outer bulb 3 for containing the inner bulb 2 are attached coaxially to a base 4. The inner bulb 2 is a cylindrical tube made of quartz glass having a top end 2*a* formed into a spherical shape, the outer bulb 3 is a cylindrical tube made of hard glass having a top end 3*a* formed into a spherical shape, and the base 4 is formed of ceramics for a portion for attaching the bottom end 2*b* of the inner bulb 2 and the bottom end 3*b* of the outer bulb 3.

Further, in the inner bulb 2, an exhaust tube 5 protrudes from the central region at the top end 2*a* of the inner bulb 2 and a bottom end 2*b* of the inner bulb 2 to be secured by a pasty low temperature curable heat resistance adhesive to a supporting post 6 formed at the central region of the base 4 is crushed by pinch sealing into a flattened shape. Then, a spacer $S_1$ made of a thin metal sheet is attached to the top end 2*a* of the inner bulb 2 for coaxially supporting the inner bulb 2 to the outer bulb 3.

The spacer $S_1$ has an annular central plate 7 to be attached to the exhaust tube 5 by insertion of the exhaust tube 5 protruded from the central region at the top end 2*a* of the inner bulb 2 through the circular aperture 8 of the spacer $S_1$, and four strips 9, 9, - - - branched radially outward each at 90° interval from the central plate 7. In the central plate 7, four fingers 10, 10, - - - for securing the central plate 7 to the exhaust tube 5 are protruded inward each at 90° interval along the inner periphery of the circular aperture 8 for allowing the exhaust tube 5 to be inserted through the exhaust tube 5.

The strips 9, 9, - - - of the spacer $S_1$ are configured each into a curved shape such that the top end 9*t* of the strip 9 is put between the inner periphery of the outer bulb 3 and the outer periphery of the inner bulb 2 in the vicinity of the spherical top end 2*a* of the inner bulb 2 so as not to substantially interrupt a light emitted from the light emitting tube 1 contained in the inner bulb 2 to ensure a predetermined distance therebetween thereby coaxially supporting the inner bulb 2 to the outer bulb 3.

This can prevent or suppress that the strips 9, 9, - - - of the spacer $S_1$ interrupt a light emitted from the inner bulb 2 thereby causing uneven illumination or shadow, or lowering the efficiency of utilizing an effective light. The top end 9*t* of the strip 9 put between the inner periphery of the outer bulb 3 and the outer periphery of the inner bulb 2 has an angular folded shape to the inner periphery of the outer bulb 3 but the shape of the top end 9*t* is not restricted only to the angular folded shape (or V-folded shape) but may also be an arcuate shape, wave shape, pleats shape (corrugate shape), or the like.

Further, the spacer $S_1$ is formed of a thin metal sheet comprising a spring stainless steel (SUS 304-CSP) of about 0.2 mm thickness and prepared by a process of punching into a developed shape having a central plate 7 formed with four fingers 10, 10, - - - along the inner periphery of a circular aperture 8 and four strips 9, 9, - - - branched radially from the central plate 7, and a process of press molding the strips 9, 9, - - - each into a curved shape as shown in the drawing.

The top end 5*a* of the exhaust tube 5 is configured as a stopper by crushing the top end 5*a* in a heat-softened state in the axial direction of the exhaust tube 5 to be thickened toward the end upon chipping off an extra length of the exhaust tube by burning off the exhaust tube by means of an oxyhydrogen flame or a carbon dioxide laser in the course of manufacturing the lamp, thereby capable of preventing the fingers 10, 10 - - - from moving toward the top end of the exhaust tube 5.

Thus, when the spacer $S_1$ is attached to the exhaust tube 5 by inserting the exhaust tube 5 protruded at the top end 2*a* of the inner bulb 2 through the circular aperture 8 formed in the central plate 7 of the spacer $S_1$, the fingers 10, 10, - - - formed along the inner periphery of the circular aperture 8 of the spacer $S_1$ are urged by the top end 5*a* thickened toward the end of the exhaust tube 5 and deformed resiliently so as to erect as shown in FIG. 3(*b*). After the top ends of the fingers 10, 10, - - - have passed the clavate top end 5*a* of the exhaust tube 5, a restoring force exerts to press the top ends of the fingers 10, 10, - - - to the outer periphery of the exhaust tube 5 as shown in FIG. 3(*c*).

In the spacer $S_1$ attached to the exhaust tube 5 as described above, since the fingers 10, 10, - - - formed along the inner periphery of the circular aperture 8 of the central plate 7 are inhibited from movement toward the clavate top end 5*a* of the exhaust tube 5, this can avoid the anxiety that the spacer is dropped out or inclined from the top end a of the inner bulb 2 thereby disfiguring the appearance of the lamp by vibrations or impact shocks during transportation of the lamp.

Further, since there is no anxiety that the spacer $S_1$ is detached and dropped out of the top end 2*a* of the inner bulb 2 even when the top end 9*t* of the strips 9, 9, - - - is not in press contact with the inner periphery of the outer bulb 3 and the outer periphery of the inner bulb 2, an operation of capping the outer bulb 3 over the inner bulb 2 attached with the spacer $S_1$ can be carried out smoothly by providing a clearance between the top end 9*t* of the strips 9, 9, - - - and the inner periphery of the outer bulb 3 to such an extent as not impairing the concentricity between the inner bulb 2 and the outer bulb 3. In addition, this can also prevent friction between the inner surface of the outer bulb 3 and the strips 9, 9, - - - of the spacer $S_1$ upon capping the outer bulb 3 over the inner bulb 2 that may cause scratch damages and invite complains in view of the quality. Further, since the spacer $S_1$ can be mass-produced easily by the operation of punching a thin metal sheet such as a thin stainless steel sheet into a developed shape having the central plate 7 and the strips 9, 9, - - - and by the operation of press molding the strips 9, 9, - - - into the curved shape as shown in the drawing, the production cost therefor is not increased.

Second Embodiment

Figure 4:
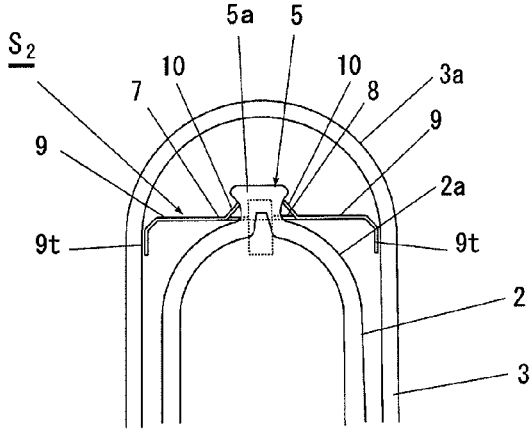
FIG. 4 is an enlarged fragmentary cross sectional view of a lamp according to a second embodiment of the invention.

FIG. 4 is a fragmentary enlarged cross sectional view showing a lamp according to a second embodiment of the invention. In the lamp of this embodiment, a spacer $S_2$ to be attached to an exhaust tube 5 protruded from the central portion at the top end 2*a* of an inner bulb 2 is formed into a curved shape for coaxially supporting the inner bulb 2 to the outer bulb 3 by abutting the top end 9*t* of strips 9, 9, - - - to the inner periphery of an outer bulb 3 in the vicinity of the top end 2*a* of the inner bulb 2. Then, the lamp of FIG. 4 is different from the lamp of the first embodiment in which the spacer $S_1$ is formed into a curved shape where the top end 9*t* of the strips 9, 9, - - - is put between the inner periphery of the outer bulb 3 and the outer periphery of the inner bulb 2 for coaxially supporting the inner bulb 2 to the outer bulb 3.

Further, in order not to interrupt an effective light emitted from the inner bulb 2, the strips 9, 9, - - - of the spacer $S_2$ is configured as a simple curved shape by merely extending the same from the top end of the inner bulb 2 horizontally toward the inner periphery of the outer bulb 3 and bending the top end 9*t* as a short hook so as to conform with the inner periphery of the outer bulb 3. Since the central plate 7 of the spacer $S_2$ is not only supported to the exhaust tube 5 by inserting the exhaust tube 5 through the circular aperture 8 formed in the central plate 7 but also secured to the exhaust tube 5 by the fingers 10, 10, - - - formed inward along the inner periphery of the circular aperture 8, there is no anxiety that the spacer $S_2$ inclines during transportation of the lamp which may possibly invite complains in view of the quality, as well as there is no anxiety that the spacer $S_2$ is dropped out of the top end 2*a* of the inner bulb 2.

Third Embodiment

Figure 5A:
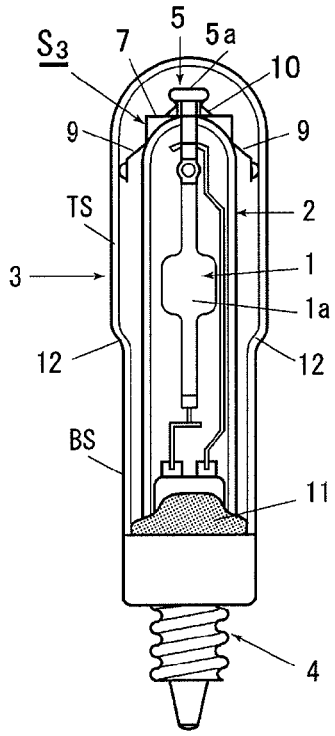
FIGS. 5(*a*)-(*b*) show a cross section of a lamp according to a third embodiment of the invention in which FIG. 5(*a*) is an entire view of the lamp and FIG. 5(*b*) is an enlarged fragmentary view of the lamp shown in FIG. 5(*a*)
Figure 5B:
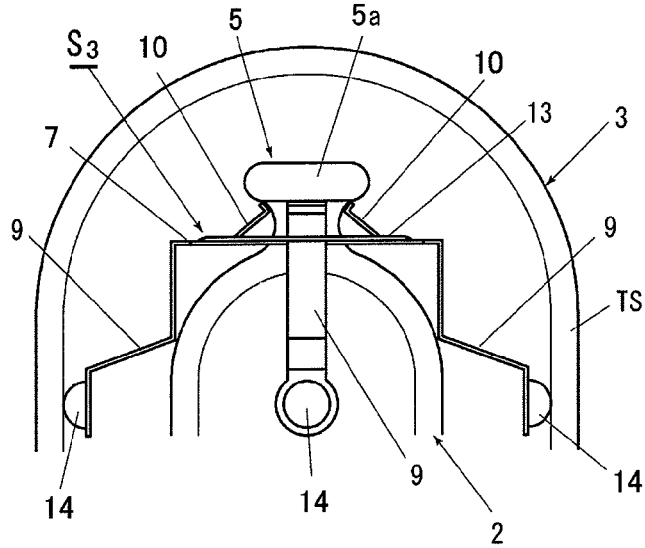
Figure 6A:
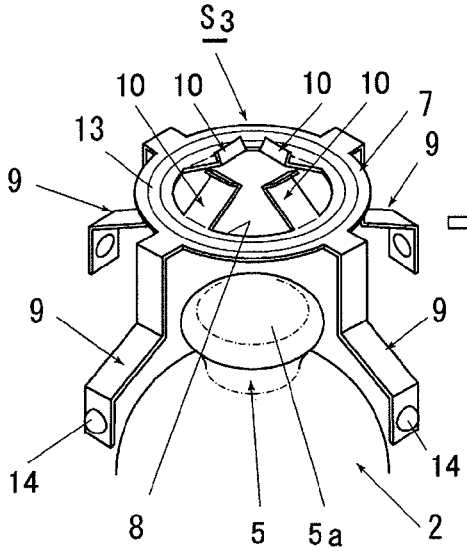
FIGS. 6(*a*)-(*b*) show a state of attaching the spacer used for the lamp shown in FIG. 5 to an inner bulb, in which FIG. 6(*a*) shows a state before attachment and FIG. 6(*b*) shows a state after attachment.
Figure 6B:
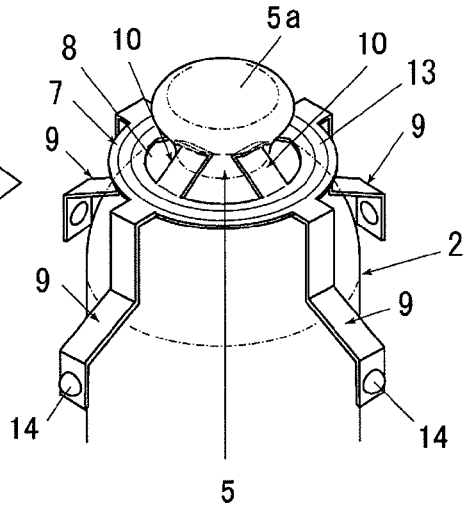
Figure 7A:
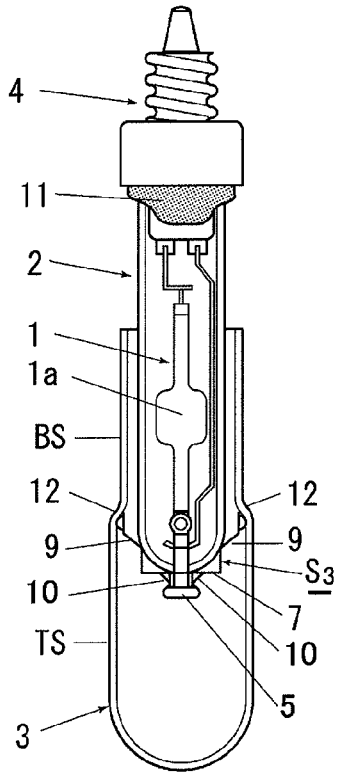
FIGS. 7(*a*)-(*b*) show the state when an outer bulb of the lamp shown in FIG. 5 is detached from a base in which FIG. 7(*a*) is an entire cross sectional view and FIG. 7(*b*) is an enlarged fragmentary cross sectional view thereof.
Figure 7B:
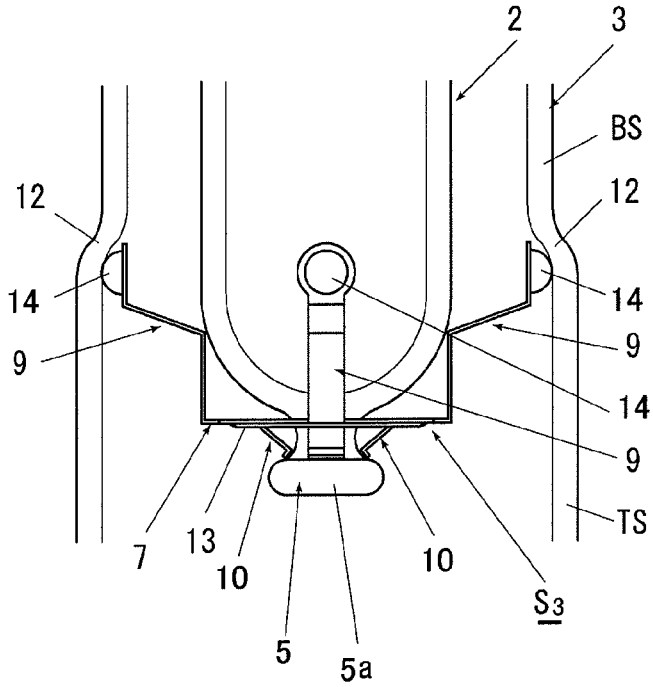

FIG. 5(*a*) is an entire view and FIG. 5(*b*) is an enlarged fragmentary cross sectional view of a lamp according to a third embodiment of the invention, FIG. 6(*a*) and FIG. 6(*b*) are perspective views showing the state of attaching a spacer used for the lamp to an inner bulb, and FIG. 7(*a*) is an entire view and FIG. 7(*b*) is an enlarged fragmentary cross sectional view showing the state of inhibiting the dropping of the outer bulb by the spacer.

In the lamp of this embodiment, an outer bulb 3 is formed as a hard glass bulb of a stepped shape which is reduced diametrically toward the bottom end BS secured to the base 4 by means of a heat resistant inorganic adhesive 11 and provided with a step 12 between the bottom end BS and a top end TS. The step 12 of the outer bulb 3 is disposed at a position localized from the position opposing to a light emitting portion 1*a* toward the base 4 in order not to scatter a light emitted from a light emitting portion 1*a* of a light emitting tube 1 contained in an inner bulb 2 as less as possible. Further, the outer bulb 3 is formed such that the thickness of the tube on the side of the bottom end BS is about 1.2 mm so that the base end BS and the base 4 for securing the same are made thin, and the tube thickness on the side of the top end TS surrounding the light emitting portion 1*a* of the light emitting tube 1 contained in the inner bulb 2 is defined as about 1.5 mm which is larger than the tube thickness on the side of the bottom end BS so as to withstand impact shocks caused by bursting of the light emitting tube 1.

Then, a spacer $S_3$ to be attached to an exhaust tube 5 protruded from the central region at the top end of the inner bulb 2 is configured to a curved shape of abutting against the inner periphery of the outer bulb 3 on the side of the top end TS in the vicinity of the top end of the inner bulb 2 to ensure a predetermined distance between the inner periphery of the outer bulb 3 and the outer periphery of the inner bulb 2, thereby coaxially supporting the inner bulb 2 to the outer bulb 3. This can prevent or suppress that the strips 9, 9, - - - interrupt a light emitted from the light emitting tube 1 contained in the inner bulb 2 thereby causing uneven illumination or shadow or lowering the efficiency of utilizing an effective light.

Further, in the central plate 7 of the spacer $S_3$, four fingers 10, 10, abutting against the outer periphery of the exhaust tube 5 are formed inward each at 90° interval along the inner periphery of the circular aperture 8 for allowing the exhaust tube 5 to be inserted therethrough, and an annular rib 13 of an arcuate cross section is formed coaxially with the circular aperture 8 in order to increase the mechanical strength of the central plate 7. Further, a semi-spherical concave portion 14 is formed to each of the strips 9, 9, - - - of the spacer $S_3$ at the top end thereof for abutting against the inner periphery of the outer bulb 3.

Further, in the same manner as in the first and the second embodiments, the exhaust tube. 5 protruded from the central region at the top end of the inner bulb 2 is configured as a stopper by axially crushing the top end 5*a* of the exhaust tube in a heat-softened state to be thickened toward the end upon chipping off an extra length of the exhaust tube 5 by burning off the same by means of an oxyhydrogen flame or a carbon dioxide laser in the course of manufacturing the lamp, to thereby inhibit movement of the finger 10, 10, - - - formed to the central plate 7 of the spacer $S_3$, toward the top end of the exhaust tube, thereby preventing the dropping out of the central plate 7 from the exhaust tube 5.

Thus, the lamp of the third embodiment is free of anxiety that the spacer $S_3$ is dropped out or inclined from the top end of the inner bulb 2 thereby disfiguring the appearance of the lamp by vibrations or impact shocks exerting during transportation. In addition, when the adhesive 11 for securing the outer bulb 3 to the base 4 is deteriorated and the outer bulb 3 is detached from the base 4, the step 12 of the outer bulb 3 is caught on the strips 9, 9, - - - of the spacer $S_3$ as shown in FIGS. 7(*a*)-(*b*), and dropping of the outer bulb 3 can be prevented reliably.

Fourth Embodiment

Figure 8A:
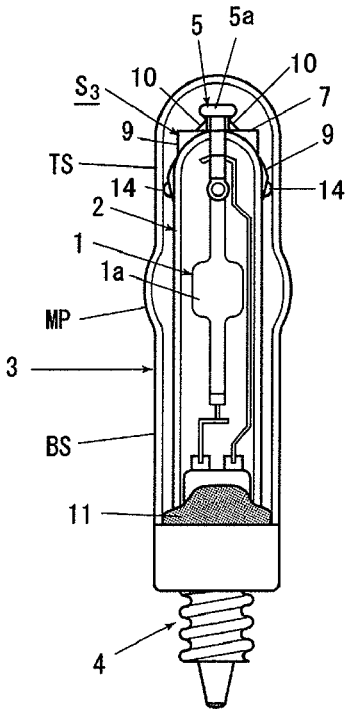
FIGS. 8(*a*)-(*b*) shows a cross section of a lamp according to a fourth embodiment of the invention in which FIG. 8(*a*) is an entire view of the lamp and FIG. 8(*b*) is an enlarged fragmentary view of the lamp.
Figure 8B:
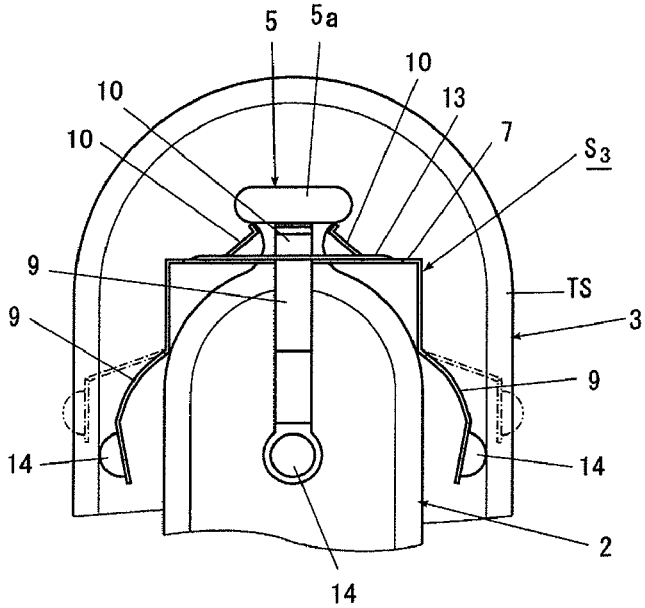
Figure 9A:
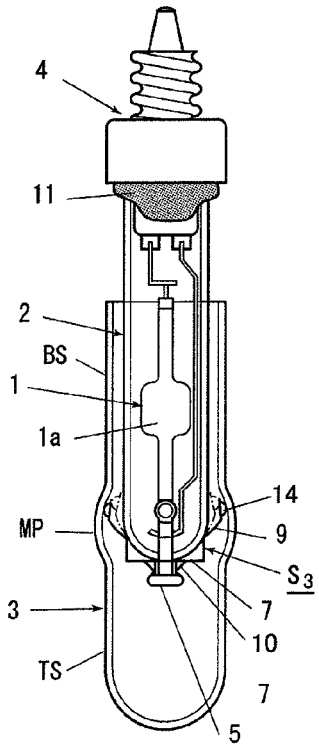
FIGS. 9(*a*)-(*b*) show the state when the outer bulb of the lamp shown in FIG. 8 is detached from the base in which FIG. 9(*a*) is an entire cross sectional view and FIG. 9(*b*) is an enlarged fragmentary cross sectional view thereof.
Figure 9B:
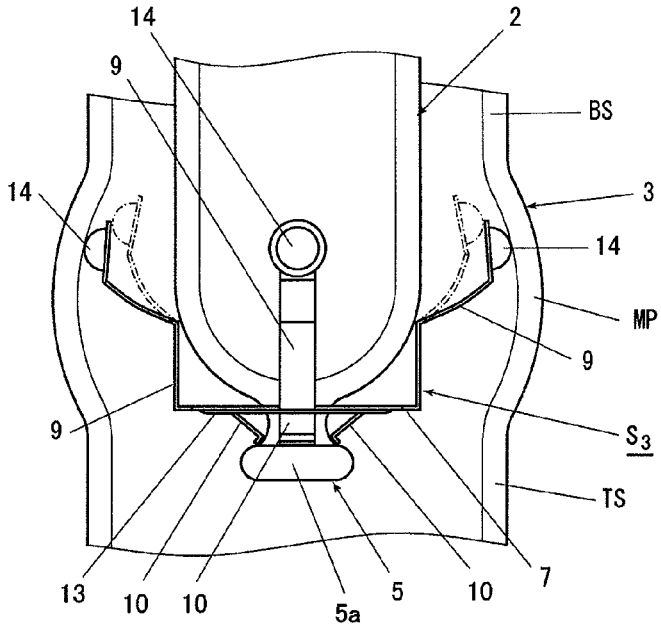
Figure 10:
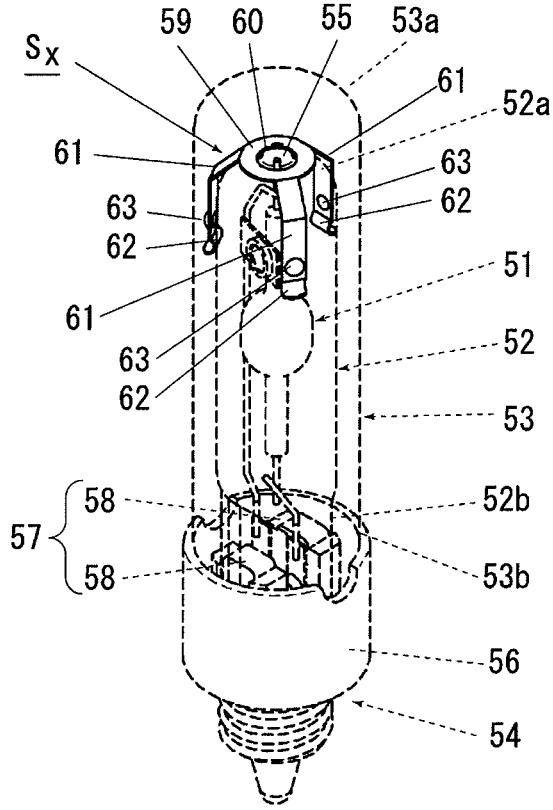
Fig. 10 (Prior art)
FIG. 10 is a perspective view showing an existent lamp.
Figure 11:
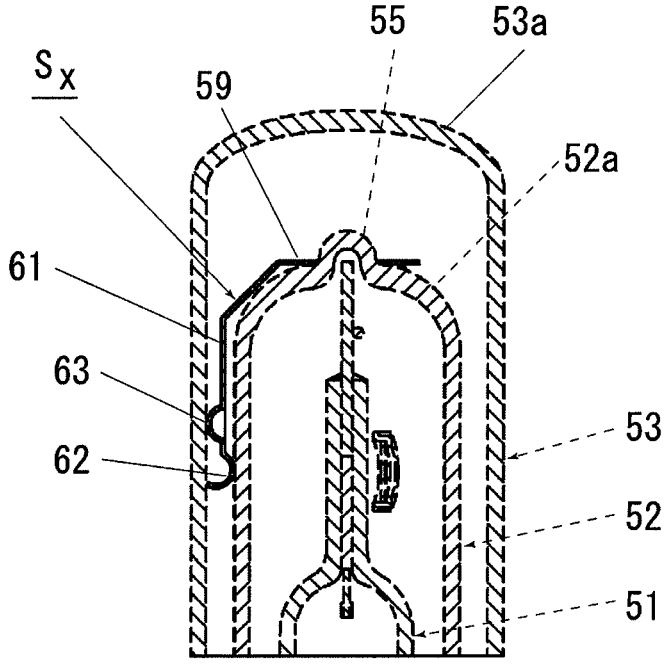
Fig. 11 (Prior art)
FIG. 11 is an enlarged fragmentary cross sectional view of the lamp shown in FIG. 10.
Figure 12:
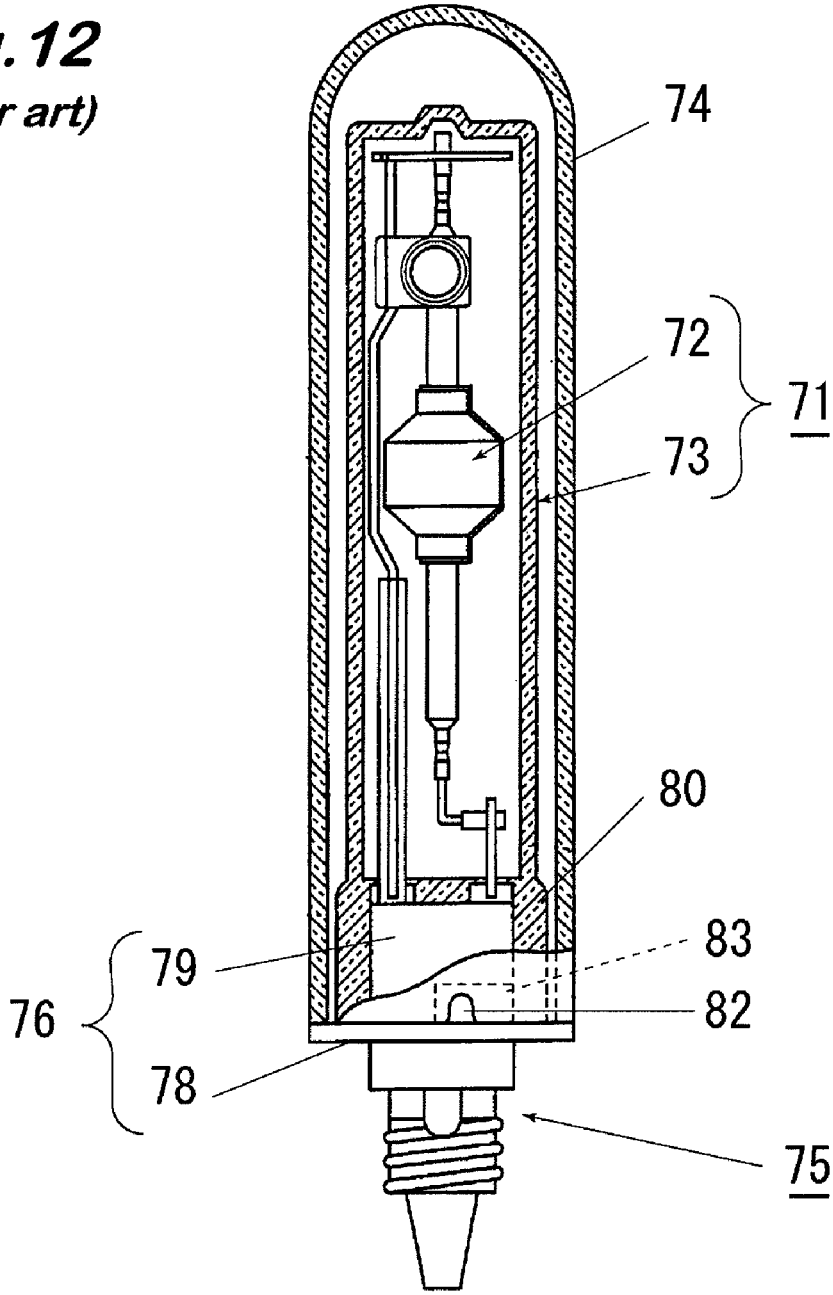
Fig. 12 (Prior art)
FIG. 12 is a cross sectional view showing an existent lamp.
Figure 13A:
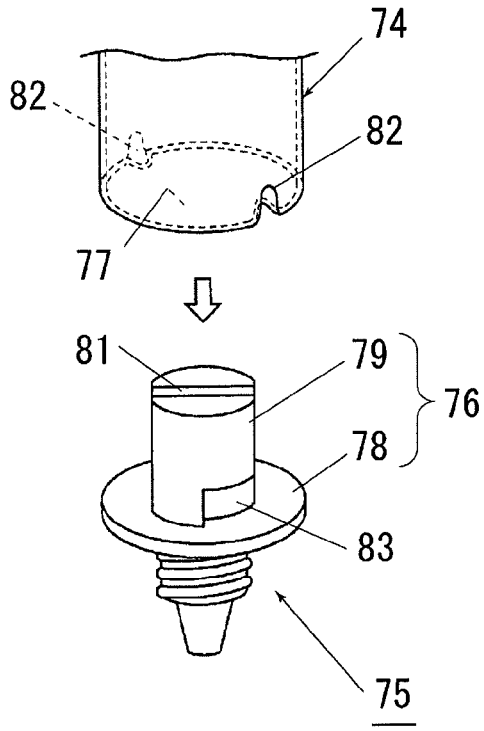
Fig. 13(a) (Prior art)
FIGS. 13(*a*)-(*b*) show enlarged fragmentary cross section of a bayonet mechanism in the lamp shown in FIG. 12, in which FIG. 13(*a*) shows an example of the bayonet mechanism and FIG. 13(*b*) shows another example of the bayonet mechanism.
Figure 13B:
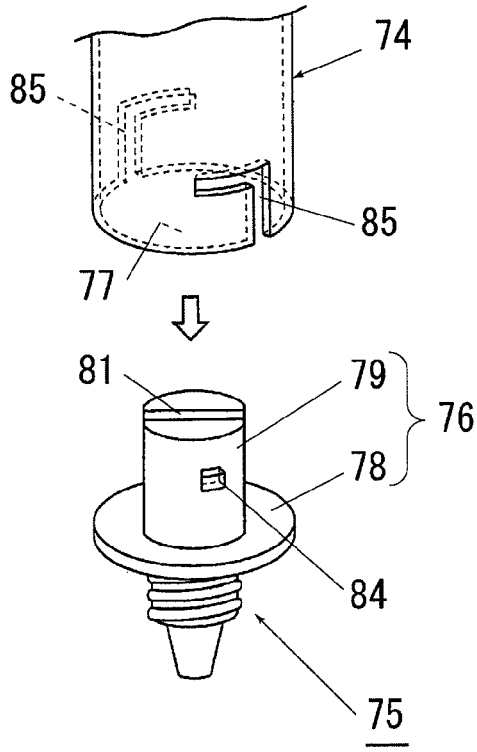
Fig. 13(b) (Prior art)

FIG. 8(*a*) is an entire view and FIG. 8(*b*) is an enlarged fragmentary cross sectional view of a lamp according to a fourth embodiment of the invention, FIG. 9(*a*) is an entire view and FIG. 9(*b*) is an enlarged fragmentary cross sectional view showing the state of preventing dropping of an outer bulb by a spacer.

In the lamp of this embodiment, an outer bulb 3 is formed of a hard glass bulb in which an intermediate portion MP between the side of a cylindrical top end TS and the side of a cylindrical bottom end BS secured by a heat resistant adhesive 11 to a base 4 is bulged spherically or elliptically. As shown in FIG. 8(*a*), the intermediate portion MP of the outer bulb 3 bulged to the spherical or elliptic shape constitutes a portion surrounding the periphery of a light emitting portion 1*a* of a light emitting tube 1 contained in an inner bulb 2 as shown in FIG. 8(*a*).

Then, a spacer $S_3$ of a type identical with that used for the lamp of the third embodiment is attached to an exhaust tube 5 protruded from the top end of the inner bulb 2, as shown in FIGS. 8(*a*)-(*b*), and the spacer $S_3$ is configured to such a curved shape that when the outer bulb 3 is capped over the inner bulb 2, strips 9, 9, - - - are resiliently deformed from a state before capping the outer bulb 3 as shown by a chained line to a state converged inward by being pressed by the inner periphery of the outer bulb 3 as shown by a solid line thereby coaxially supporting the inner bulb 2 to the outer bulb 3.

With the constitution described above, when the adhesive 11 for securing the outer bulb 3 to the base 4 is deteriorated and the outer bulb 3 is detached from the base 4 and displaced toward the top end, as shown in FIGS. 8(*a*)-(*b*), the strips 9, 9, - - - of the spacer $S_3$ which have been in the resiliently deformed state so as to be converged inward being pressed by the inner periphery of the outer bulb 3 on the side of the top end TS is expanded from the state shown by the dotted chain in FIGS. 9(*a*)-(*b*) to the state expanding outward shown by the solid line in FIGS. 9(*a*)-(*b*) in the spherically or elliptically intermediate portion MP of the outer bulb 3 and the bottom end BS of the outer bulb 3 is caught on the strips 9, 9, - - - in the extended state, thereby preventing dropping of the outer bulb 3.

Further, when the plate width for the trips 9, 9, - - - of the spacer $S_3$ made of a spring stainless steel of 0.2 mm thickness is selected to about 2 to 3 mm, the strips are resiliently deformed so as to be converged inward being pressed by the inner periphery of the outer bulb 3 on the side of the bottom end BS and on the side of the top end TS, without applying a not so large force upon capping the outer bulb 3 over the inner bulb 2. Accordingly, this enables smooth operation of capping the outer bulb 3 over the inner bulb 2 and at the same time, dropping of the outer bulb 3 can be prevented reliably since the strips have a strength enough to support the load of the outer bulb 3 detached from the base 4, While each of the spacers $S_1$ to $S_3$ of the first to fourth embodiments has four strips 9, 9, - - - , since the inner bulb 2 can be coaxially supported to the outer bulb 3 when the spacer has the strips 9, 9, - - - at least by the number of three, the number of the strips is not restricted to four but may be three or more. Further, while the exhaust tube 5 in each of the first to fourth embodiments is configured as the stopper so that the top end 5*a* of the exhaust tube 5 inhibits the movement of the fingers 10, 10, - - - in the direction toward the top end of the exhaust tube 5 by forming the exhaust tube into a clavate shape, the invention is not restricted only thereto but the top end of the exhaust tube may be configured as the stopper, for example, by providing protrusions, ridges, etc. that protrude radially at the top end of the exhaust tube 5. Further, while the lamps for each of the first to fourth embodiments is the triplet tube-walled metal halide lamp, the invention is applicable also to a double-walled halogen lamp.

The present invention contributes to the improvement of the quality and the reliability of a triple-walled metal halide lamp having a light emitting tube, an inner bulb for containing the light emitting tube, and an outer bulb for containing the inner bulb, or a double-walled halogen lamp having an inner bulb for containing a light emitting filament and an outer bulb for containing the inner bulb.

DESCRIPTION OF THE REFERENCES

1 light emitting tube
2 inner bulb
3 outer bulb
4 base
5 exhaust tube
$S_1$ spacer
$S_2$ spacer
$S_3$ spacer
7 central plate
8 circular aperture
9 strips
10 fingers

What is claimed is:

1. A lamp in which an inner bulb for containing a light emitting tube or a light emitting filament and an outer bulb for containing the inner bulb are attached coaxially to a base, and a spacer made of a thin metal sheet is attached to an exhaust tube protruded from a central region at the top end of the inner bulb for coaxially supporting the inner bulb to the outer bulb, wherein the spacer has a central plate formed with an aperture for allowing the exhaust tube to be inserted therethrough and having a plurality of fingers protruded inward along the inner periphery of the aperture, and three or more strips each branched radially outward from the central plate and formed in a curved shape for coaxially supporting the inner bulb to the outer bulb, and the exhaust tube is configured wider at the end on which the fingers of the spacer are held, as a stopper capable of inhibiting the movement of the fingers toward the top end of the exhaust tube, thereby preventing the central plate from dropping out of the exhaust tube.

2. A lamp according to claim 1, wherein the spacer is formed of a spring stainless steel of about 0.2 mm thickness.

3. A lamp according to claim 1, wherein the strip is configured into a curved shape that abuts against the inner periphery of the outer bulb in the vicinity of the top end of the inner bulb, thereby coaxially supporting the inner bulb to the outer bulb.

4. A lamp according to claim 1, wherein the strip is configured to a curved shape that is put between the inner periphery of the outer bulb and the outer periphery of the inner bulb in the vicinity of the top end of the inner bulb, thereby coaxially supporting the inner bulb to the outer bulb.

5. A lamp according to claim 1, wherein the central plate is formed with a circular aperture for allowing the exhaust tube to be inserted through the central plate and an annular rib having an arcuate cross section formed coaxially with the circular aperture.

6. A lamp according to claim 1, wherein the outer bulb is formed of a glass bulb provided with a step between the bottom end and the top end of the outer bulb by diametrically decreasing the side of the bottom end secured to the base by means of an adhesive.

7. A lamp according to claim 6, wherein the light emitting tube is contained in the inner bulb and the step of the outer bulb is provided at a position localized from the position for the light emitting tube toward the base.

8. A lamp according to claim 7, wherein the bulb thickness on the side of the top end of the outer bulb is greater than the bulb thickness on the side of the bottom end of the outer bulb.

9. A lamp according to claim 1, wherein the outer bulb is formed of a glass bulb in which an intermediate portion between the top end and the bottom end secured to the base by means of an adhesive is bulged spherically or elliptically, and the strip is configured to a curved shape for coaxially supporting the inner bulb to the outer bulb in a state deformed resiliently so as to be converged inward being pressed to the inner periphery of the outer bulb on the side of the top end.

* * * * *